United States Patent [19]

Crawford et al.

[11] 4,235,329

[45] Nov. 25, 1980

[54] ARTICLE GROUPING AND TIERING APPARATUS

[75] Inventors: Donald C. Crawford; John S. Aterianus, both of Green Bay, Wis.

[73] Assignee: FMC Corporation, San Jose, Calif.

[21] Appl. No.: 711,656

[22] Filed: Aug. 4, 1976

[51] Int. Cl.[3] ..... B65G 47/26

[52] U.S. Cl. ..... 198/419; 198/422; 53/153; 414/29; 414/46

[58] Field of Search ..... 198/419, 420, 422, 425, 198/435, 436, 440, 442, 459, 491, 732; 214/6 F; 53/152, 164, 153; 414/29, 46

[56] References Cited

U.S. PATENT DOCUMENTS

| | | | |
|---|---|---|---|
| 3,217,859 | 11/1965 | Bartlo et al. | 198/425 |
| 3,340,672 | 9/1967 | Kayser | 53/164 |
| 3,391,777 | 7/1968 | Joa | 198/422 |
| 3,455,085 | 7/1969 | McIntyre | 198/435 |
| 3,700,090 | 10/1972 | Pearson | 198/425 |
| 3,845,852 | 11/1974 | Langen et al. | 198/732 |

*Primary Examiner*—Joseph E. Valenza
*Attorney, Agent, or Firm*—C. E. Tripp; L. J. Pizzanelli

[57] ABSTRACT

This application discloses methods and apparatus that advance, from a single longitudinal file of abutting articles, a portion of the file containing a desired number of articles which, for convenience, will sometimes be referred to as a sub-group. The first and subsequent sub-groups are sequentially further advanced to a magazine or collection station preferably constructed with overlying vertically spaced compartments. On each compartment containing a sub-group of articles, and for purposes of this description bringing together the sub-groups will be referred to as a group, the group is advanced to the forming box of a horizontal form, fill and seal wrapping machine which essentially produces, from a flat strip of thermoplastic material, a tube having its edges welded and which is thereafter transversely severed and sealed between groups of articles. In advancing the accumulated individual articles of each sub-group in the formation of a group the articles rest upon the lower article aligned therewith.

3 Claims, 13 Drawing Figures

3
3
52
54
56
58
58
62
62a
64
66
68
70
71
72
72a
72b
74
74
76
80
118
120
122
124
126
127
130
132
134
136
138
140
142
144
146
148
150
152
154
154
155
155
156
156
158
160
48
50
50
50

178
97
170
174
174
171
172
175
184
182
90
96
90
94
90
92
98
88
176
176
158
158
72a
74
71
71
155
70
112
156
154
154
78
114
116
116
72b
71
71
156
154
160
160
72a
72

ARTICLE GROUPING AND TIERING APPARATUS

FIELD OF THE INVENTION

This invention relates to methods and apparatus for arranging discrete articles in groups and more particularly packaging articles arranged in groups by a horizontal form, fill, and seal machine.

SUMMARY OF THE INVENTION

In accordance with the present invention individual articles, preferably consumable products such as candy bars, are fed to a conveyor having freely rotating support rollers. The articles define a longitudinally aligned file which, by virtue of the freely rotating rollers, are maintained in abutting relation. Means in line with and constituting a continuation of the conveyor but formed by transversely spaced U-shaped rails, supports the opposed end portions of each article and defines a temporary storage unit for a series of articles which will form a sub-group. The storage unit comprises a section which is sequentially transversely movable relative to the adjacent rail portions. On movement of the movable rail portions a selected number of articles are segregated from the longitudinal file. Immediately thereafter a transfer mechanism, having a finger or lug projecting between and engageable with the last article supported by the spaced rails, transfers the sub-group to the temporary storage unit.

Further in accordance with the present invention sequentially operable mechanism, which may be responsive to the accumulation of two or more sub-groups in the temporary storage unit, concurrently conveys sub-groups, hereinafter sometimes called "a group" or "tiered layers," to the forming box of a horizontal form, fill, and seal machine. As usual the tubularly formed thermoplastic web has its longitudinal edges sealed and a conventional head is provided for transversely sealing and severing the web tube between product groups to create individually overwrapped packages.

DESCRIPTION OF THE PREFERRED EMBODIMENT

Figure 1:
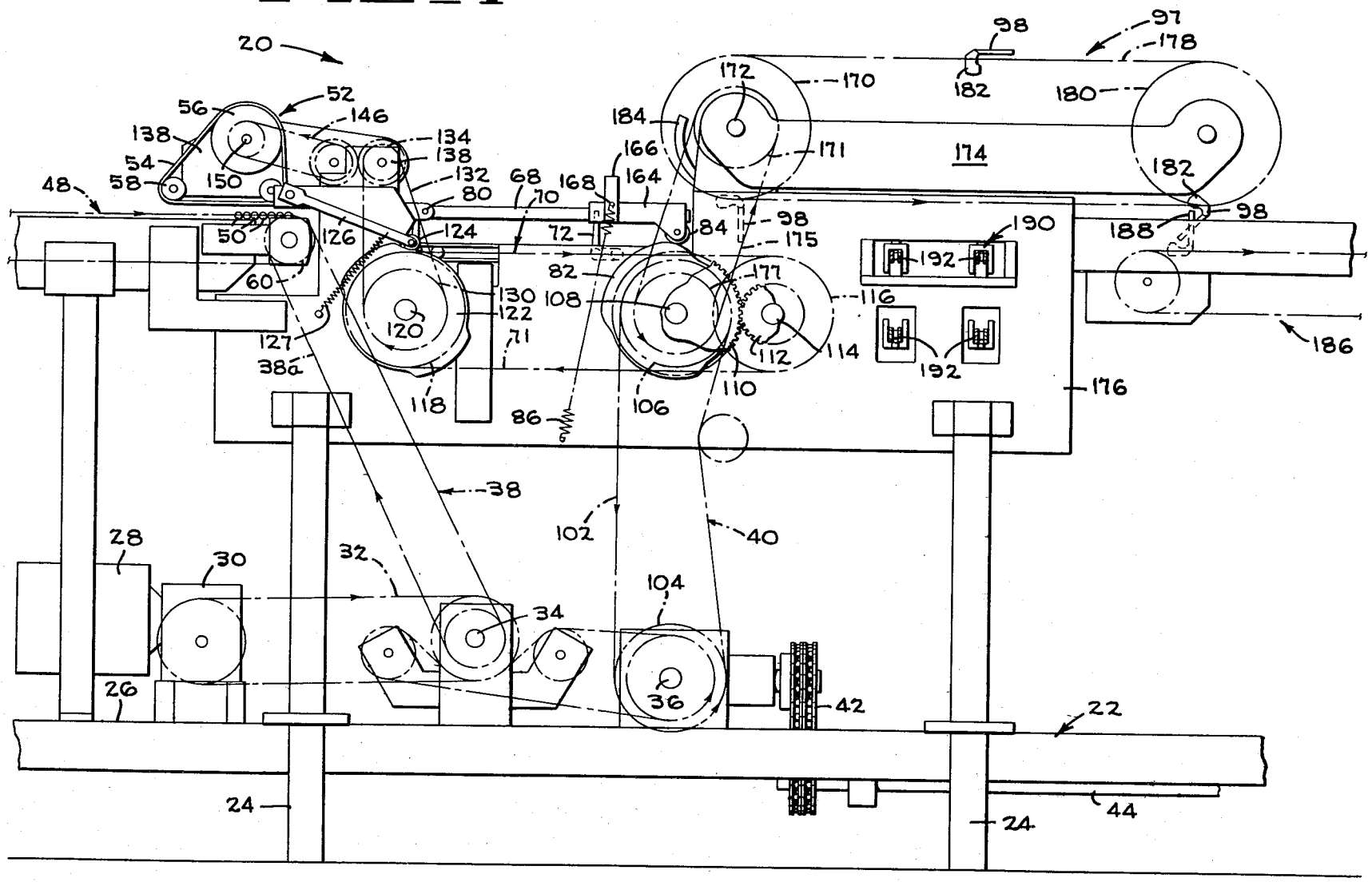
FIG. 1 is a side elevation of the article grouping and tiering apparatus incorporating and constructed in accordance with the principles and concepts of the present invention.

The preferred form of the article grouping and tiering apparatus constructed in accordance with the principle of the present invention is shown in FIG. 1 and identified by the numeral 20. A frame structure 22, including a plurality of vertical legs 24, comprises a platform 26 for mounting some of the drive and driven components of the machine. Supported on the platform 26 is a motor 28 connected to a reducer 30, the output of which is connected by a chain and sprocket arrangement 32 to drive shafts 34 and 36. Associated with the shaft 34 are two conventional one way clutches whose purpose will be presently described. Chain and sprocket drives 38 and 40 drive operate components of the tiering and grouping apparatus. The main input drive for the shafts 34 and 36 is provided by a line shaft 44 drivingly connected, partly by means of a chain and sprocket arrangement 42, to the shafts 34 and 36.

When the main wrapper drive is stopped either by the operator or due to the insufficiency of articles being fed to the wrapping machine the motor 28 is energized to effect, through the chain and sprocket arrangement 38 operation of an infeed conveyor 48 which includes a plurality of transversely extending closely adjacent freely rotating product supporting rollers 50. When driving of the shafts 34 and 36 occur by virtue of the energization of the motor 28, one of the one way clutches is rendered operative while the other one way clutch normally driven by the line shaft 44 is inoperative. The conveyor 48 is provided for creating and supporting a longitudinally aligned single file of articles that are divided into sub-groups and groups containing two or more of such sub-groups. Overlying the discharge end of the conveyor 48 to create light pressure contact with the leading series of articles, is a feed assisting mechanism 52 which may include one or more belts 54 trained about a drive pulley 56 and idler pulleys 58.

Figure 2:
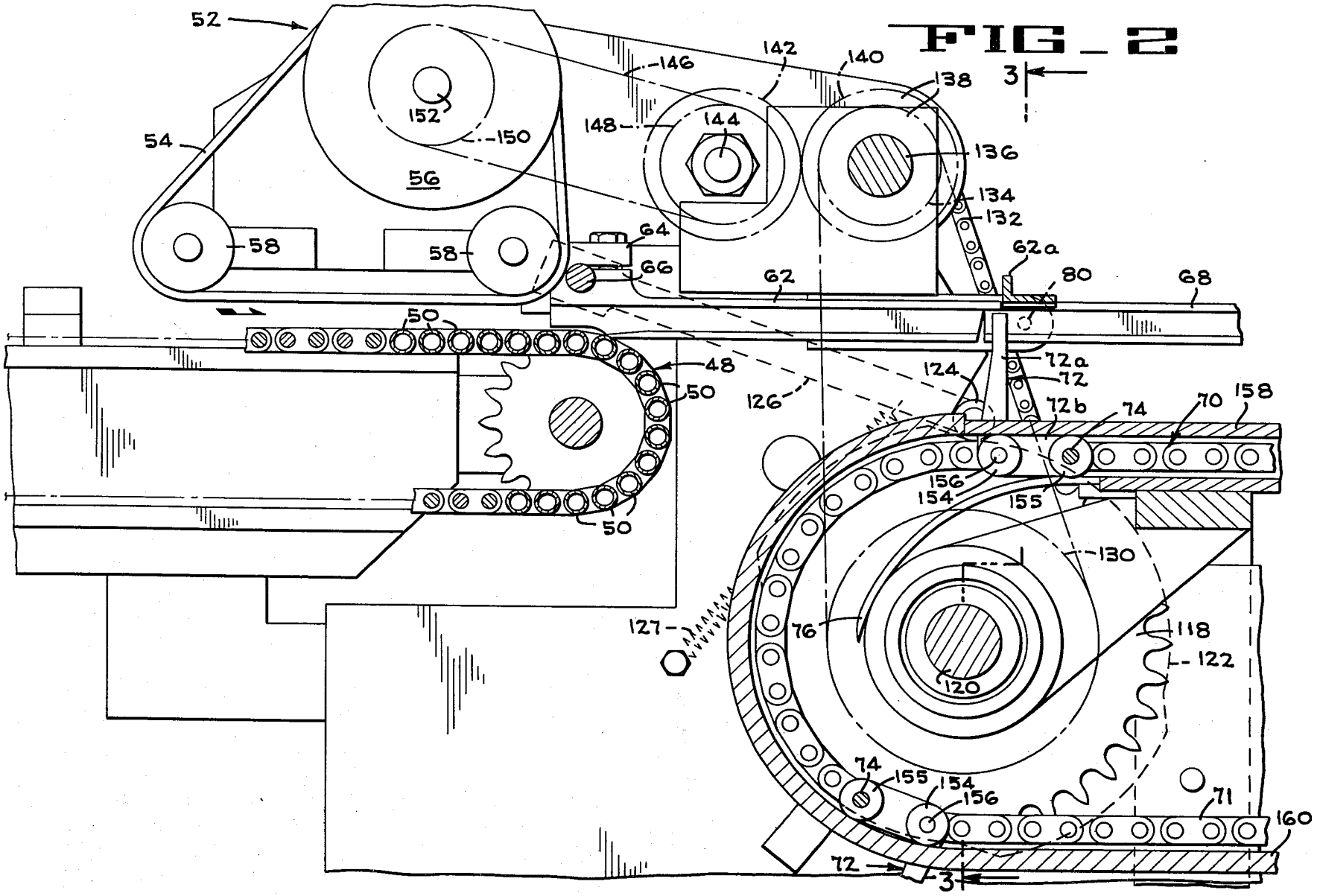
FIG. 2 is a greatly enlarged fragmentary portion of FIG. 1 illustrating that portion of the apparatus that creates and transports a sub-group of products.
Figure 4:
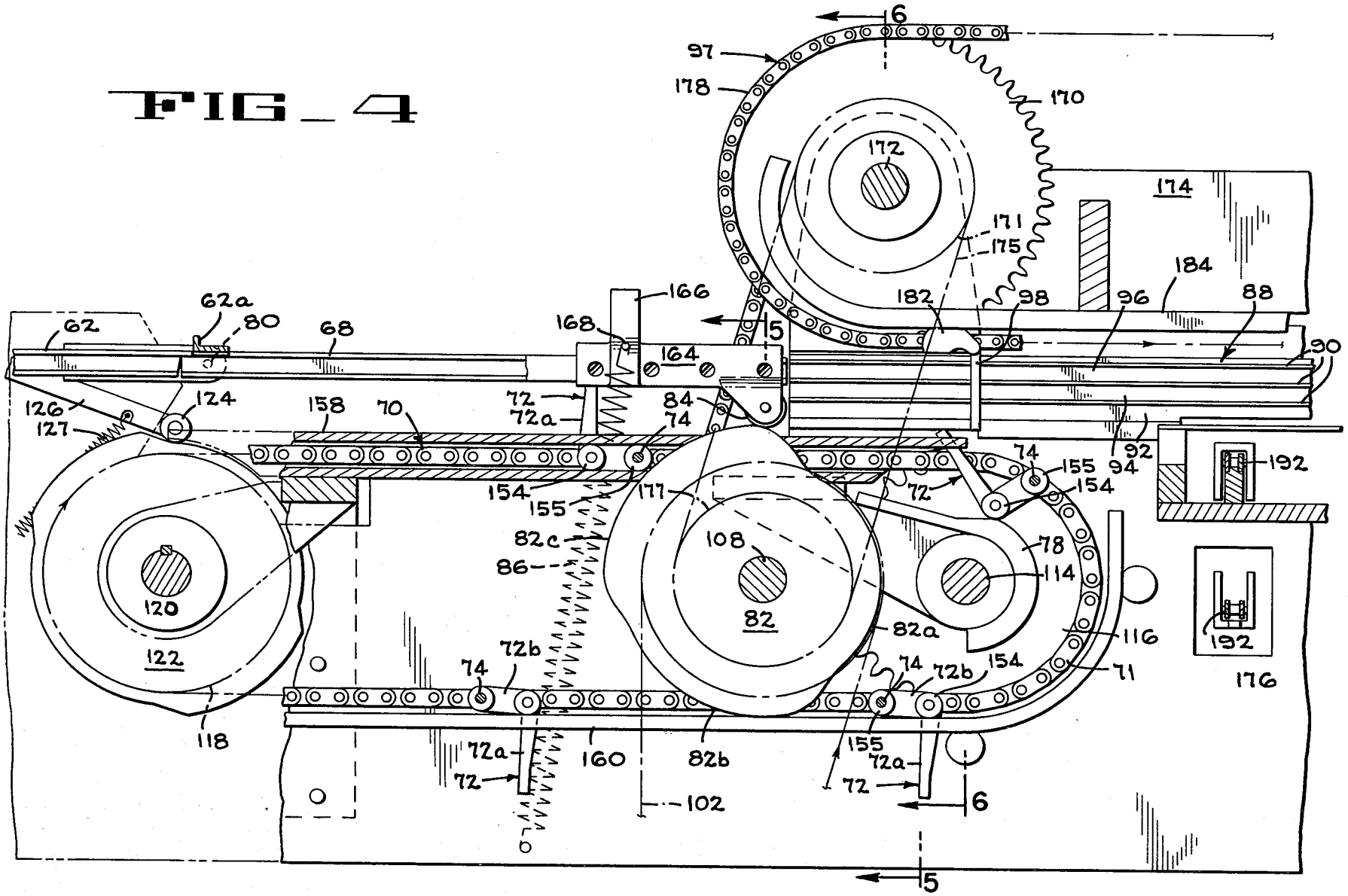
FIG. 4 is an enlarged fragmentary portion of FIG. 1 illustrating the sub-group tiering mechanism.

As shown on FIG. 2, the leading portion of a group of products is transported to spaced generally U-shaped rails 62 which, by virtue of a lug clamp 64, are sequentially pivoted by a rock shaft 66. As will be explained hereinafter, the rails 62 define a temporary storage unit for a series of articles and such series of articles have hereinabove been referred to as sub-group. By virtue of hereinafter explained mechanical movements the sub-group of articles are separated from the single file of longitudinally extending articles when the rails 62 are pivoted upwardly by the rock shaft 66. The sub-group created is transported along similarly U-shaped rails 68 by an underlying conveyor 70 which is provided with a series of spaced lugs 72 mounted for free pivotal movement on pins 74 so that, in combination with camming members 76 and 78 (FIG. 4), the lugs 72 can project and recede from the last article of the sub-group being transported. The rails 68 are sequentially pivoted about pivot bolts 80 by cams 82 which are formed with a plurality of lobes **82*a*, 82*b*, and 82*c*. Cam follower rollers 84, held in firm engagement with the periphery of cams 82 by springs 86, sequentially aligns the rails 68 with a magazine or accumulating device 88 formed with inwardly extending vertically spaced thin partitions 90**.

Movement of a sub-group of articles in the spaced rails 68 by the lugs 72 allows the sub-group, assuming it is the first sub-group, to be inserted into the compartment 92 of the magazine 88 when the roller 84 is in rolling engagement with the lobe 82*a*. The subsequent sub-group is inserted into compartment 94 when the roller 84 is in rolling engagement with the lobe 82*b*. And the final sub-group is inserted into compartment 96 when the roller 84 is in rolling engagement with the lobe 82*c*.

On creation of a group an overhead conveyor 97, provided with depending lugs 98, transports the group of tiered articles to the forming box of the vertical form, fill, and seal machine whereupon the group of products are hermetically sealed in thermoplastic web material.

According to the above generalized description of the tiering apparatus 20 it will be seen that a longitudinal file of articles on conveyor 48 extend between the transversely spaced U-shaped rails 62 and then, a certain number of such articles, continue into longitudinally aligned U-shaped rails 68. The number of articles that are transferred to the rails 68 is determined by upward pivotal movement (FIG. 9) of the rails 62 and then the sub-group transferred to rails 68 is transferred by lugs 72 to the overlying compartments of the magazine 88. Once each compartment is loaded with a sub-group, a group has been created and it is then transferred by the overhead conveyor 97 to the horizontal form, fill, and seal machine.

Synchronous operation of the conveyor 70 and the conveyor 97 is achieved by a plurality of sprockets and chains which are driven by the chain and sprocket arrangement 40. In particular, a sprocket chain 102 driven by sprocket 104 keyed to the shaft 36 drives sprocket 106 keyed to a shaft 108. Also keyed to the shaft 108 are the cams 82 and a gear 110 meshing with a gear 112 keyed on a transverse shaft 114. The shaft 114 has also keyed thereto a pair of sprockets 116 about which are trained chains 71, of the conveyor 70. The chains 71 are also trained over idler sprockets 118 keyed on a transverse shaft 120. The shaft 120 also has keyed thereon a pair of transversely spaced two lobe cams 122 serving, by virtue of follower rollers 124 mounted on levers 126, to cause rocking motion of the shaft 66 which in turn is imparted to the rail portions 62. Springs 127 are connected between the levers 126 and the side frame to insure contact between the rollers 124 and the cams 122.

Figure 3:
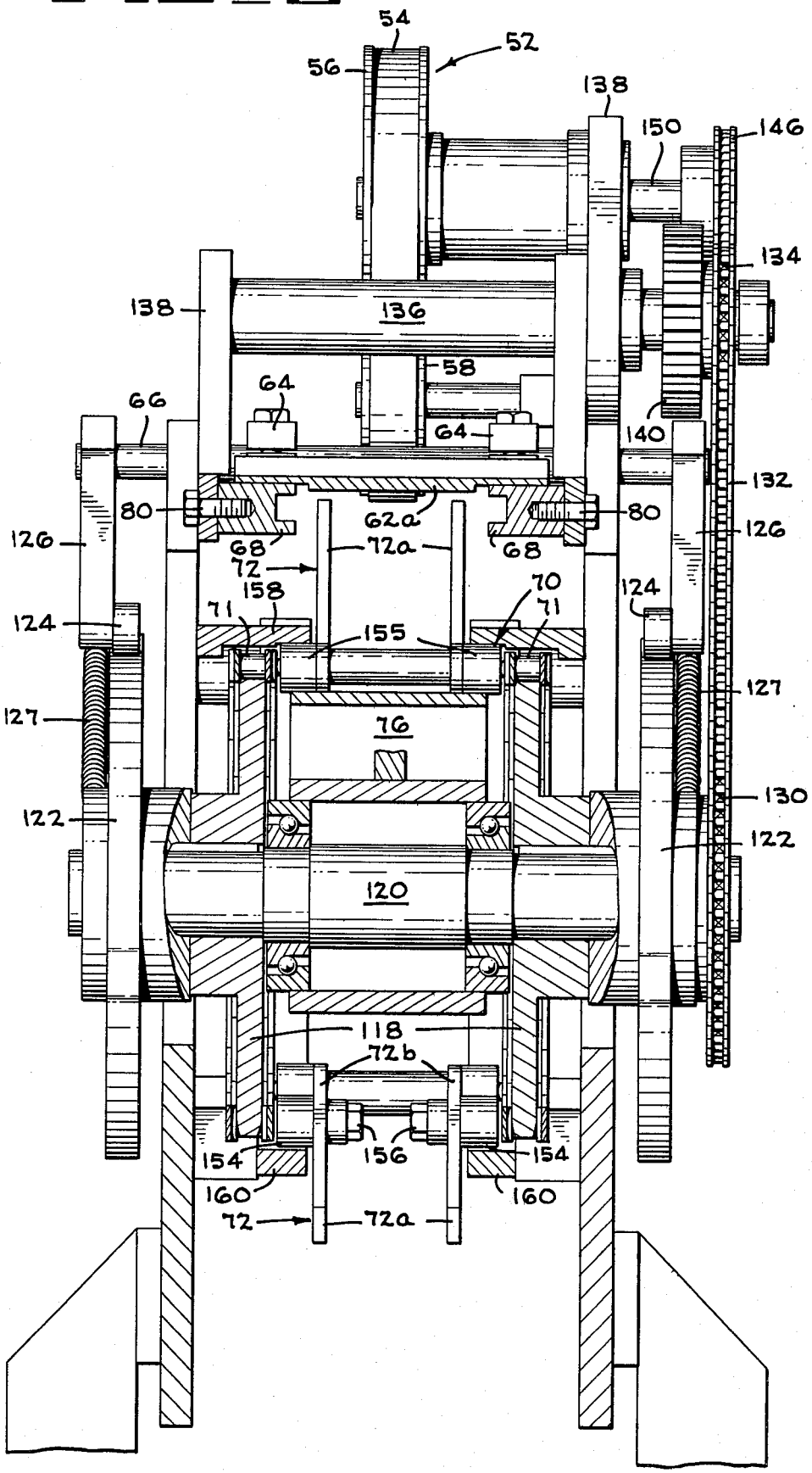
FIG. 3 is a section, taken substantially along the line 3—3 of FIG. 2, illustrating details of construction of the transport conveyor for a sub-group.

Driving of the overhead feed belt 54 is effected by a sprocket 130 that is keyed to the shaft 120 and a sprocket chain 132 trained sprocket 134 keyed on a short transverse shaft 136 rotatably mounted in transversely spaced side plates 138. As shown in FIG. 3 a gear 140 is also keyed on shaft 136 and it meshes with another gear 142 rotatably mounted on a short stub shaft 144 fixed to one of the plates 138. Driving of the pulley 56 occurs by virtue of a sprocket chain 146 trained about a driving sprocket 148 fixed to the gear 142 and a sprocket 150 keyed to the shaft 152 which also has keyed thereon the pulley 56.

Figure 8:
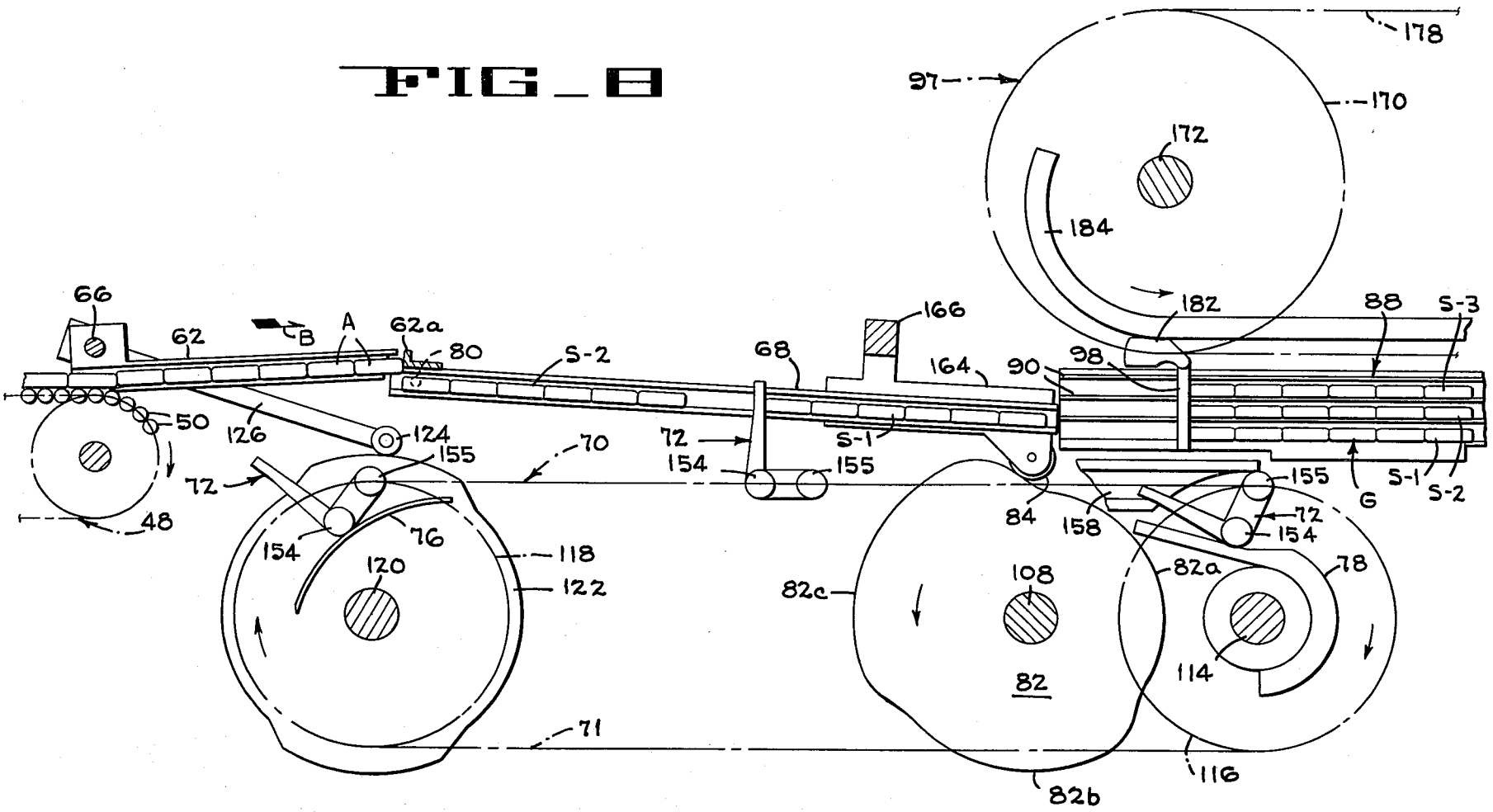
Figures 9, 9A:
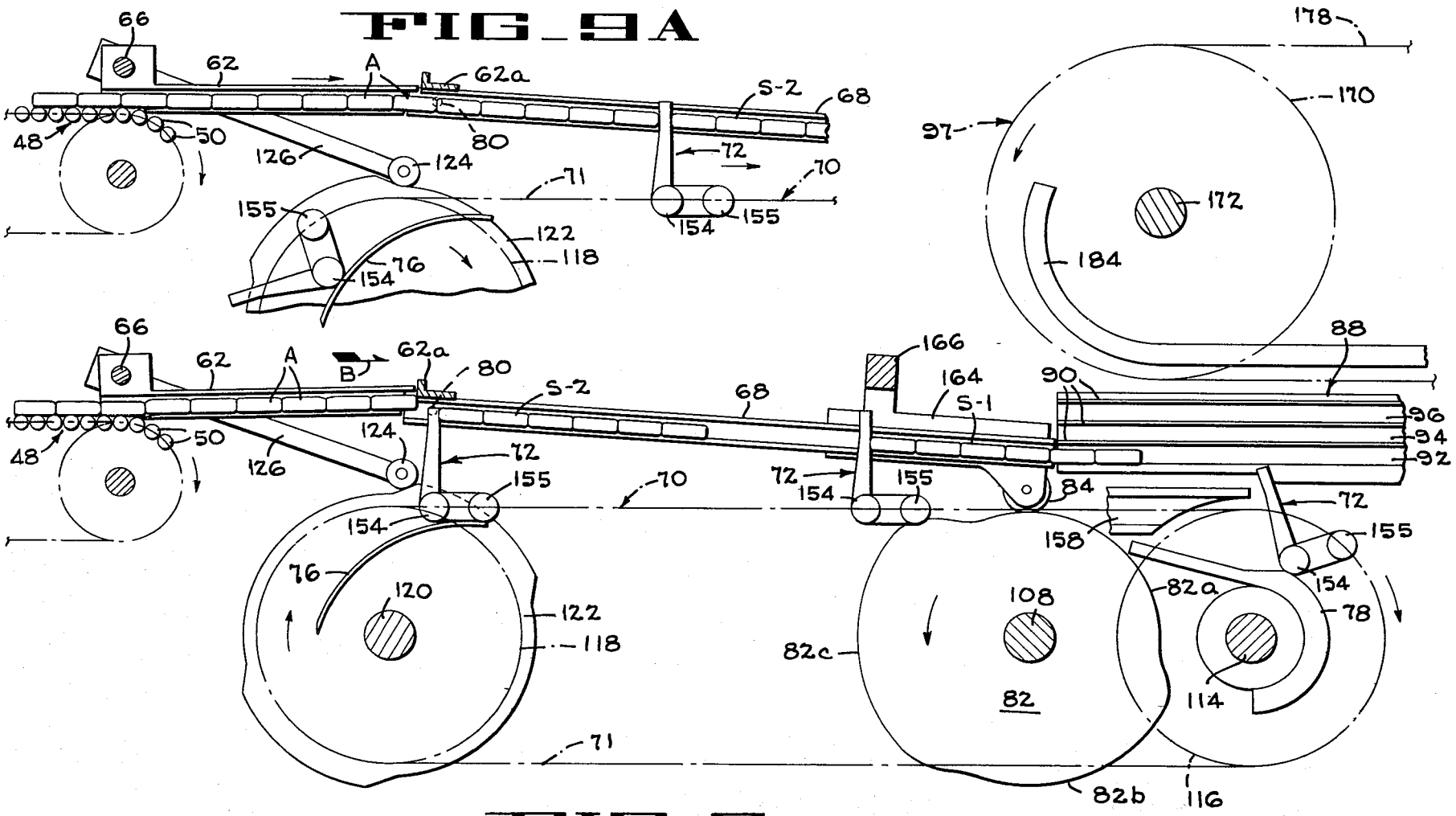

While it will be explained in greater detail hereinafter, reference to FIGS. 8 and 9 descriptively illustrates the operative sequence whereby the longitudinal file of articles A moving in a direction of the arrow B are disposed between the transversely spaced U-shaped rails 62. While the roller 124 rides on the shorter radius section of the cam 122, rails 62 are in alignment with rails 68. Well before one of the lugs 72 approaches the upper reach of the sprocket chains 71 the roller 124 rides up the rise of cam 122 pivoting the rail sections 62 about the center of the rock shaft 66 thereby arresting movement of that portion of the articles contained in rails 62 as the articles come to rest against a stop member 62*a*. This action segregates a portion of the file of articles within the rails 68 and thus define, as termed hereinabove, a sub-group. The sub-group is subsequently advanced to the magazine 88 by the lugs 72.

In accordance with the present invention, means, preferably consisting of cam 82 and pivotable U-shape rails 68, are provided for sequentially stacking articles one above each other for creation of a vertical stack with each stack containing one or a selected number of articles. While the disclosure of this application shows and describes a mode of operation and a structural configuration which is presently preferred it is to be appreciated that the concept is susceptible for application in fields other than packaging. For example the concept of segregating one or a selected number of articles from a row of articles for stacking, packaging, boxing, or warehousing is, to applicant's knowledge, per se novel. Moreover, arranging the single articles or a group of articles in overlying relationship is also considered novel per se. Accordingly, while the present application discloses these concepts in connection with overwrapping of a plurality of products, the concept and mode of operation is considered to be of applicability in a variety of fields particularly material handling as may be found in cartoning, casing, and warehousing.

In advancing a sub-group of articles from the rail sections 62 along the rails 68, the laterally spaced conveyor chains 71 have the lugs 72 supported thereon so that they may project upwardly and held in such an orientation when the lugs traverse the upper reach of the chains 71. As each lug inserts a sub-group of articles in a compartment of magazine 88 it is actuated to withdraw or recede from the sub-group it has transported. To achieve such a mode of operation each lug is generally L-shaped in configuration and the pin 74 is pivotally connected to the transversely spaced chains 71. At the intersection of the vertical leg 72*a* and the base 72*b* rollers 154 (FIG. 3) are secured by means of fasteners 156. The pins 74 are associated with rollers 155 which may be freely rotating or if desired fixed. Raceways 158 are provided for the rollers 154 and 155 and the upper reach of the conveyor chains 71. Sheet metal strips 160 form raceways for the lower reach of the conveyor chains. As shown in FIG. 2 the cam plate 76 is rigidly connected to the raceways 158 and it is formed to gradually erect the longer leg 72*a* of the lug 72 as it approaches the upper reach of the chains 71. With the rollers confined in the raceways 158 the lugs 72 are rigidified and can accordingly fulfill their function of transporting a sub-group of products to the magazine 88. As the lug approaches sprockets 116 mounted on shaft 114 the lug recedes or collapses since the raceways 158 terminates adjacent the periphery of the sprocket 116. The rollers 154 make contact with and roll along the cam member 78 which serves to ensure that the lug does not rotate or freely swing and possibly jam against the adjacent portion of the outer raceway 160.

Figure 5:
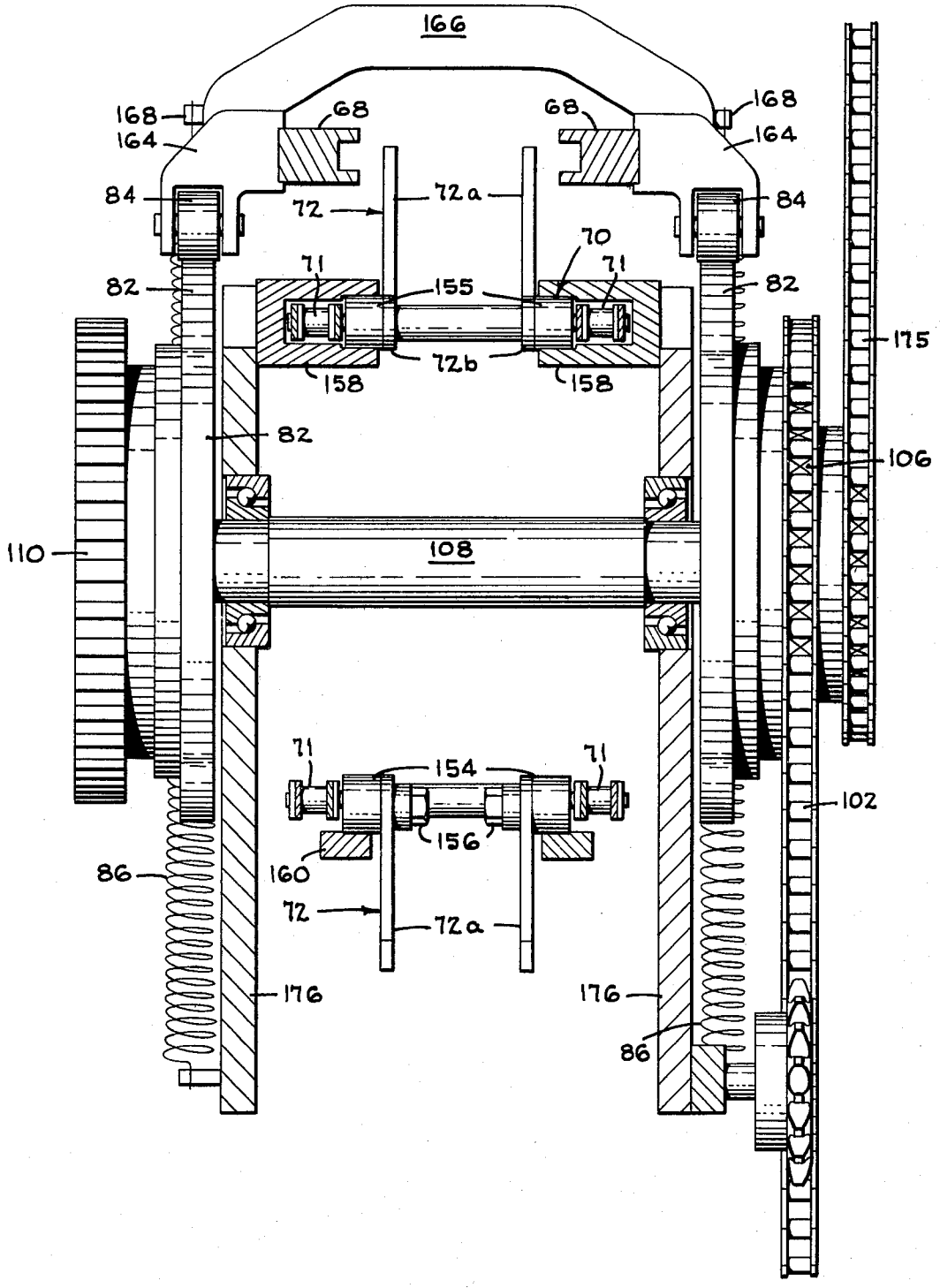
FIG. 5 is a section, taken substantially along the line 5—5 of FIG. 4, illustrating the sequentially elevatable rails and the conveyor for inserting the first and subsequent tiers of products at the proper elevation.

As mentioned previously, sprocket chain 102 drives the sprocket 106 and the three lobe cams 82, both of which are keyed on shaft 108. The rollers 84 which are held in firm engagement with the periphery of the cam 82 by springs 86, are rotatably mounted to brackets 164 which are in turn rigidly connected to the rails 68 (FIG. 5). In addition the brackets 164 are interconnected with a bridge member 166 which is provided with short laterally extending pins 168 on which are disposed the upper loops of the springs 86. As briefly explained hereinabove, on producing of a sub-group of articles, occurring when the rails 62 are shifted upwardly, the longitudinally aligned rails 68, on receiving a sub-group, are concurrently conditioned to assume an attitude with respect to the various compartments 92, 94, and 96 to sequentially insert the first and subsequent sub-groups in the compartments. While this description of the present invention discloses inserting the first sub-group in compartment 92, the second sub-group in compartment 94 and the third sub-group in compartment 96, the order is of no particular relevance since a variety of means, whether they be strictly mechanical, electronic or hydraulic or combinations thereof, can be provided to insert the sub-groups in any sequence desired. For example, the first sub-group may be inserted in compartment 96 or 94 rather than 92 and the number of sub-groups which overlie each other may be increased or decreased as desired. In any event, it is to be recognized that the scope of the present invention has general applicability in fields where a succession of single articles or groups of articles may be stacked vertically for either storage and subsequent retrieval or, as in the present disclosure, momentarily to create a group of articles which is further processed.

Figure 6:
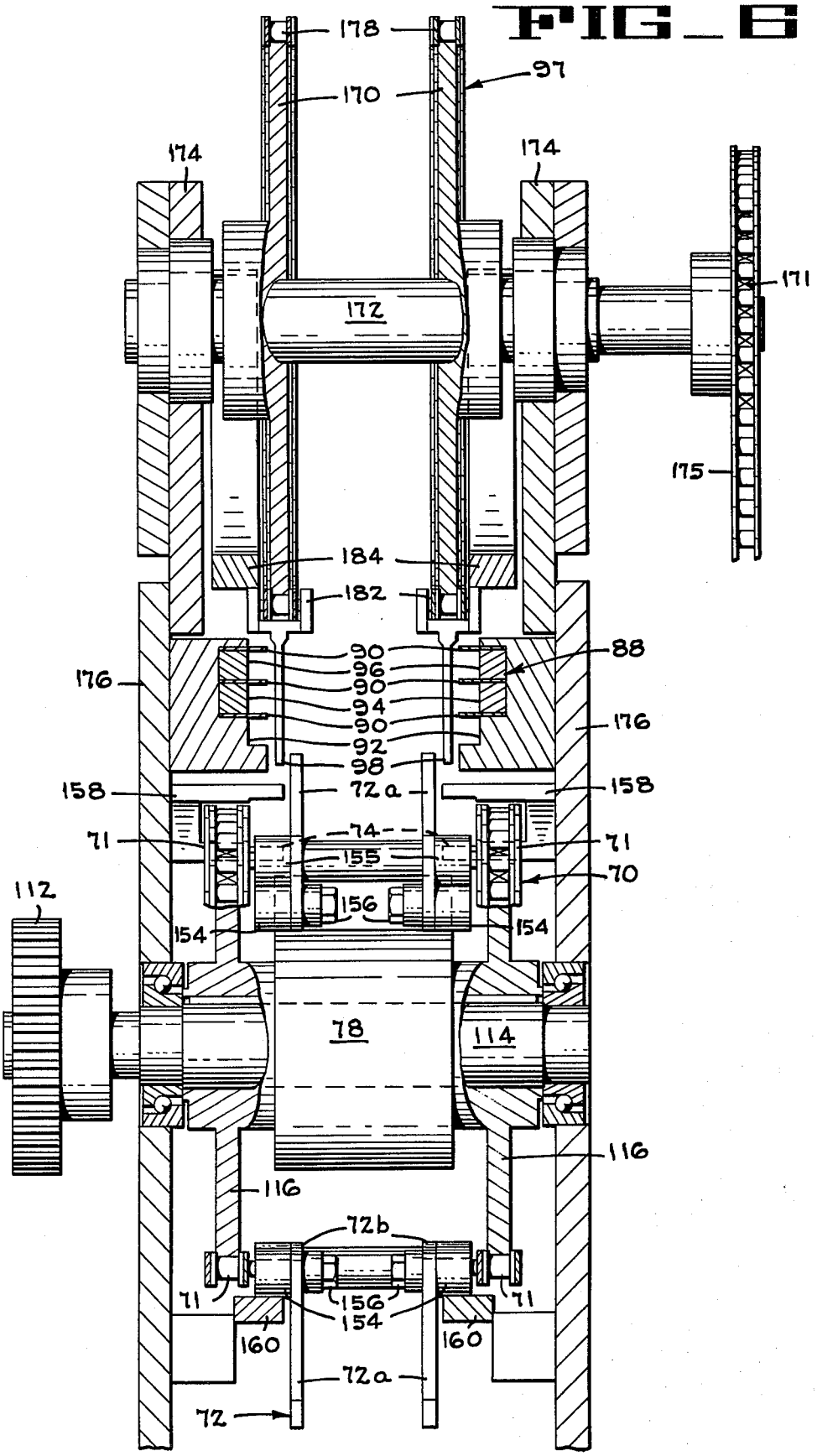
FIG. 6 is another transverse section, taken substantially along the line 6—6 of FIG. 4, illustrating the relationship of the sub-group and group product conveyors, FIG. 7, drawn to a scale similar to FIG. 4, illustrates a series of sub-groups tiered to define a group and optional mechanisms for supporting the group on a cardboard or other suitably tray, FIGS. 8 to 12 diagrammatically illustrate the operation of the grouping and tiering apparatus of the present invention.

The overhead article group feeding conveyor 97 comprises (FIGS. 4 and 6) a pair of laterally spaced-sprockets 170 and a drive sprocket 171 keyed to a shaft 172. The shaft 172 is rotatably mounted in spaced side plates 174 which are in turn suitably secured to lower adjacent side plates 176. Each sprocket 170 drives sprocket chains 178 that are trained around idler sprockets 180 also rotatably mounted in side plates 174. The lugs 98 are integral with a bifurcated base member 182 which is pivotably mounted to selected links of the chains 178 and the downward orientation of the lugs are maintained by tracks 184 which prevents pivotal movement during that period of time that a group of articles A are being transferred from the magazine 88 to the inlet or infeed conveyor 186 of the wrapping machine. As is conventional, the infeed conveyor 186 includes lugs 188 that transports the group of articles to the forming box of the wrapping machine. The shaft 172 is driven by a chain 175 driven by sprocket 177 keyed on the shaft 108.

Figure 7:
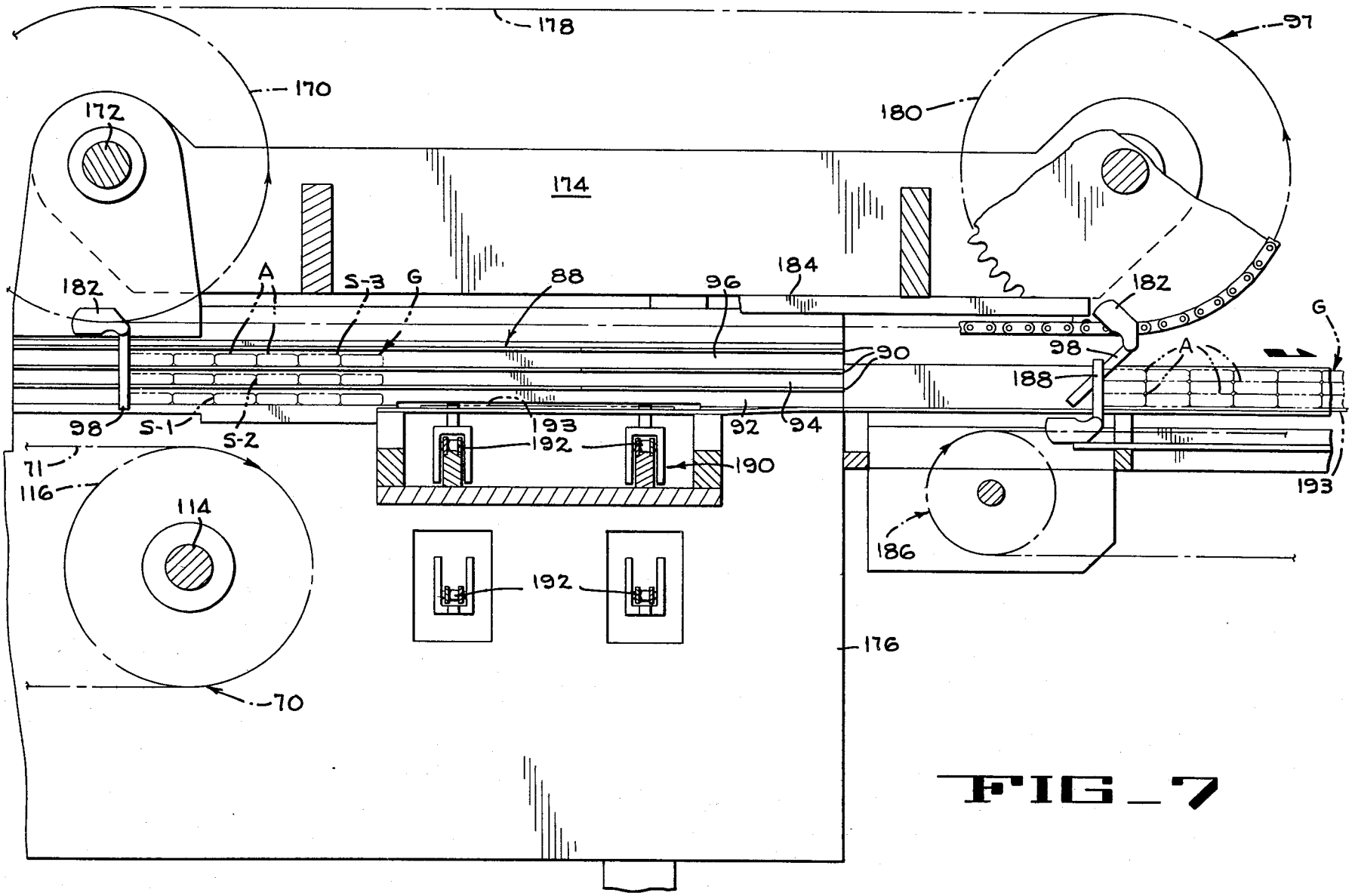

As shown in FIG. 7, as a group of articles are being advanced to the infeed conveyor 186 by the lugs 98 a tray, such as a rectangular piece of cardboard or other suitable material, is positioned in the path of the group by a transverse conveyor 190 which includes laterally spaced driven sprocket chains 192 cooperating with a dispensing machine of known construction for positioning the tray 193 in the path of the article group being transported.

Figure 10:
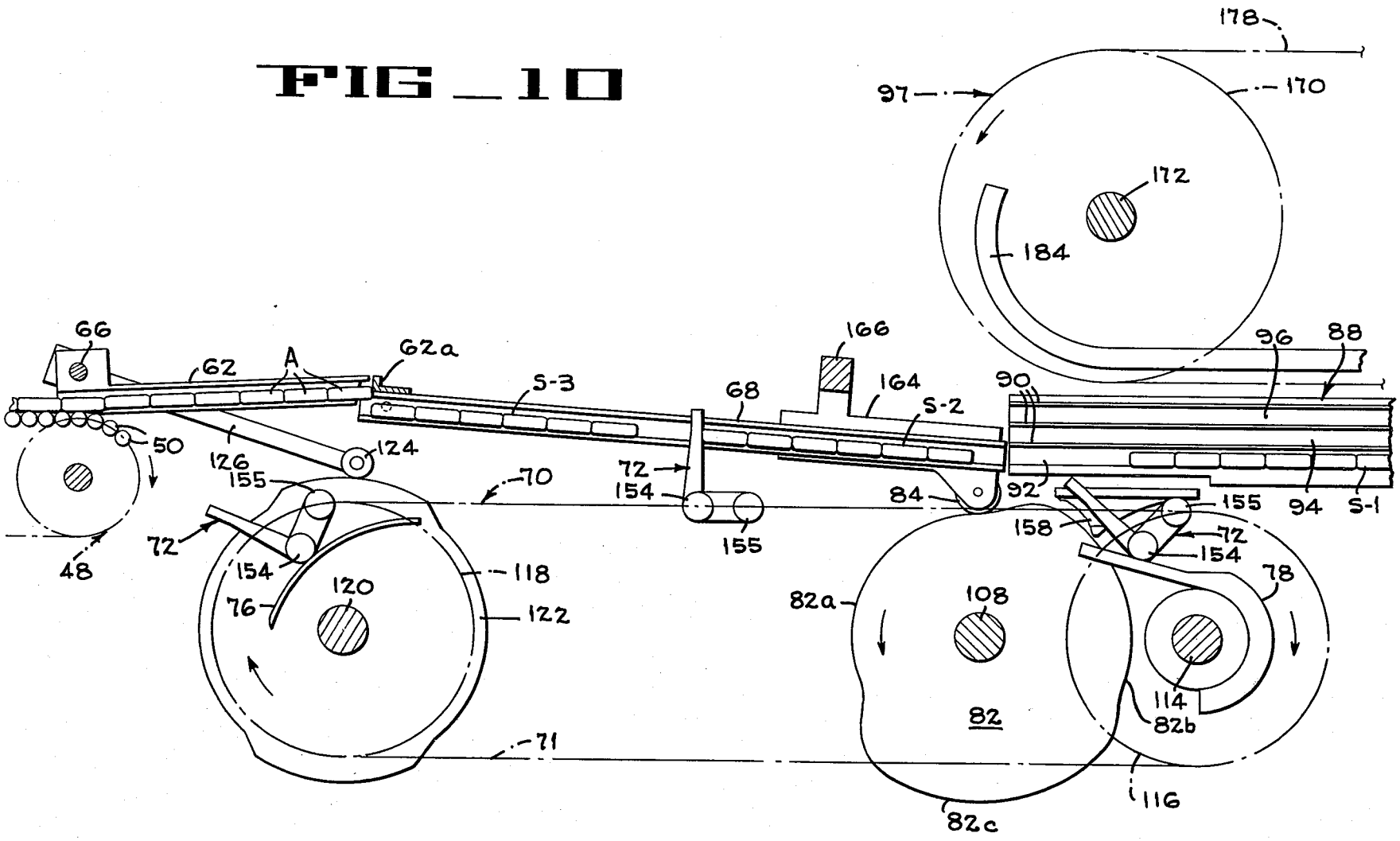
Figure 11:
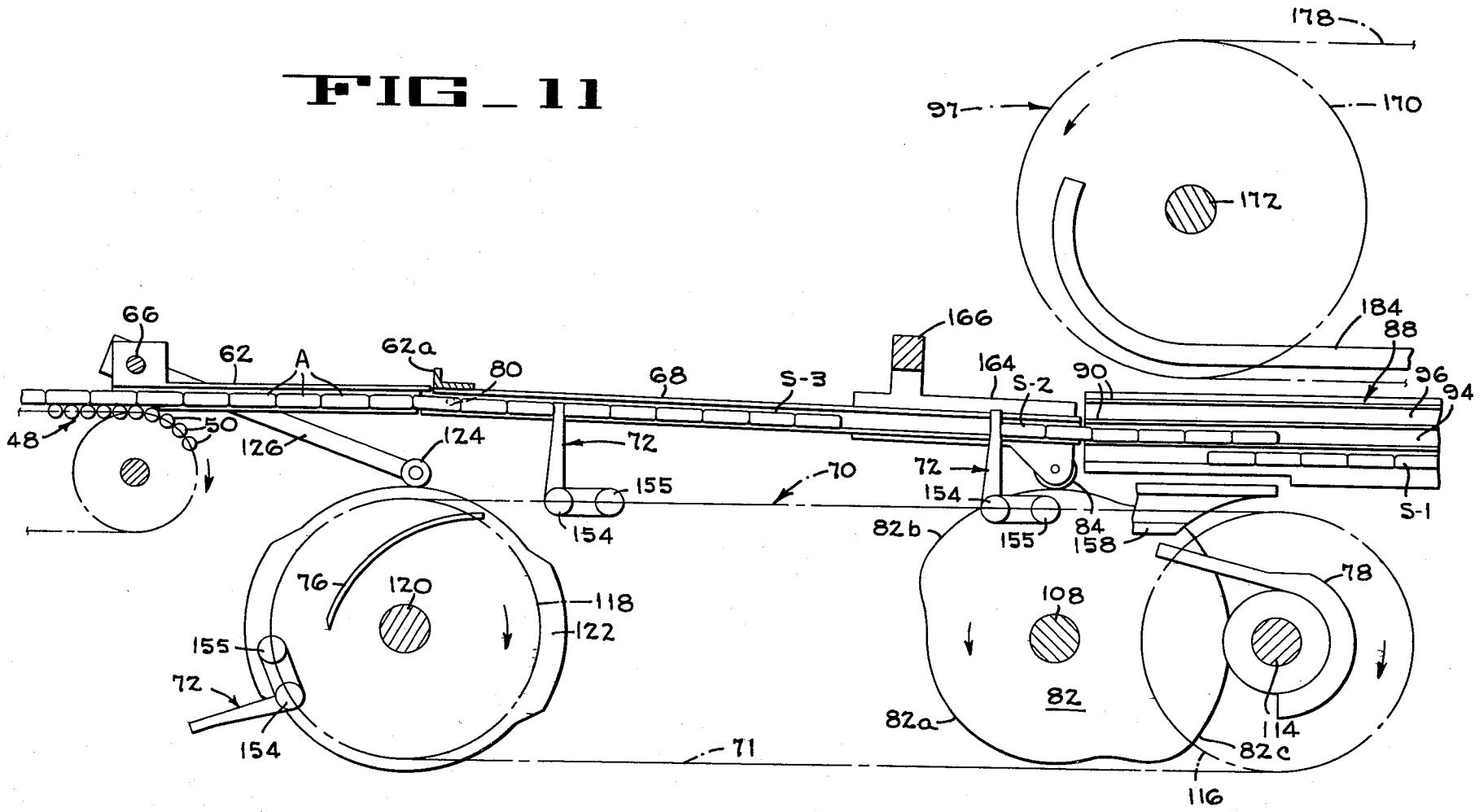
Figure 12:
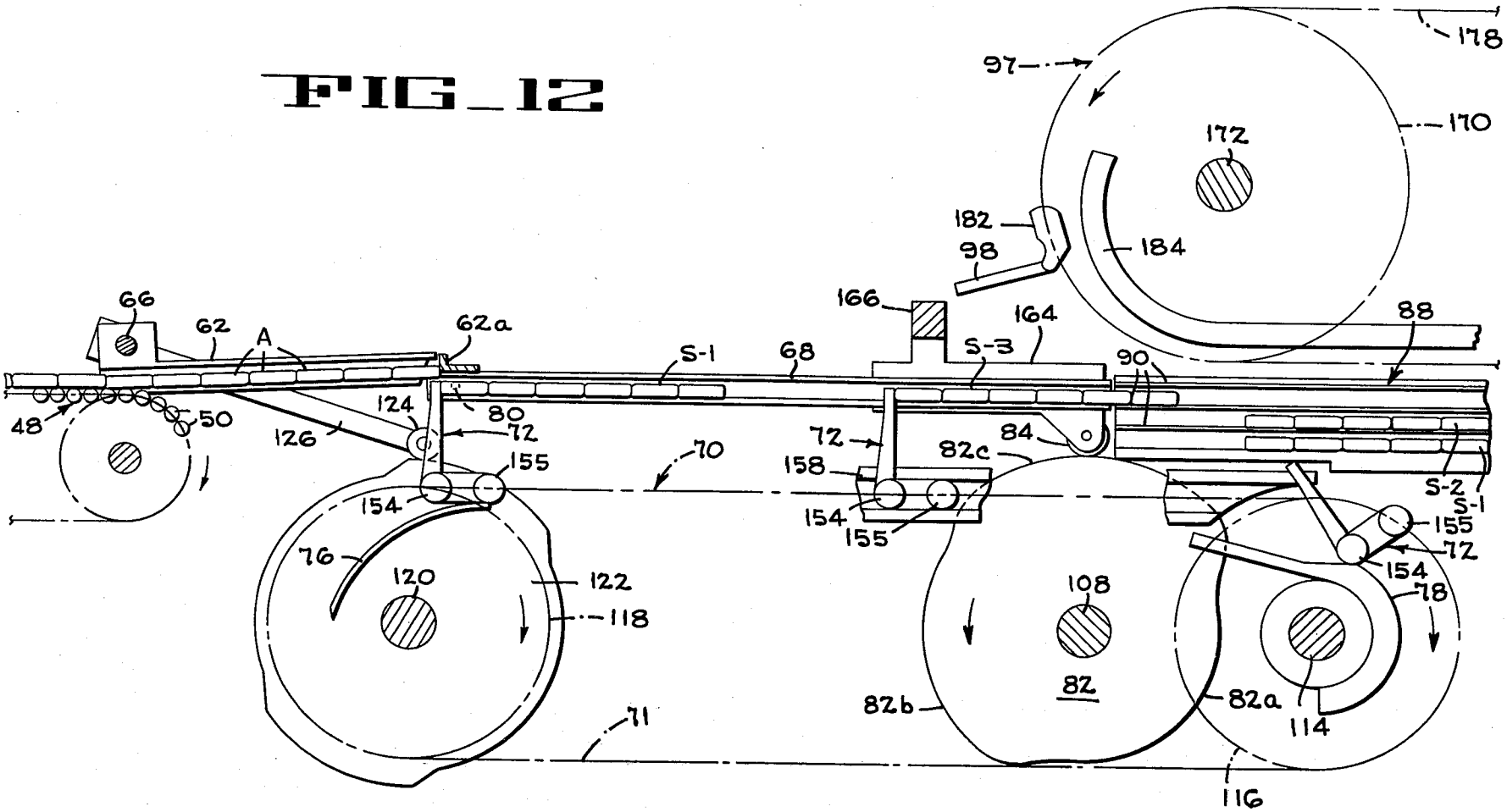

In describing the operation of the novel article grouping and tiering apparatus reference will be made to FIGS. 8 through 12. In FIG. 8 the magazine 88 is filled with three sub-groups identified from the bottom to the top as S-1, S-2, and S-3 together defining the group generally identified by the letter G. On creation of the group, one of the lugs 98 of the overhead conveyor 97 comes into position to transport the group to the wrapping machine. A subsequent sub-group S-1 which will form a layer of the successive group is being conveyed for insertion into compartment 92 and will be so positioned when the roller 84 establishes rolling engagement with the cam lobe 82*a*. This condition is shown in FIG. 9 illustrating the sub-group S-1 being inserted in compartment 92. At this time the successive sub-group S-2 has been produced and is being transported by one of the lugs 72 while the rails 62 are being pivoted downwardly to enable movement of the single file of articles. In FIG. 10 the first sub-group S-1 is shown fully inserted into compartment 92 while the second sub-group S-2 is nearing the terminal portion of the rails 68. It should be noted that the rails 62 have been misaligned with the rails 68 to arrest movement of the single file of articles and to create the third sub-group S-3 which is shown in FIG. 10. It should also be noted (FIG. 11) that the second sub-group is entering the compartment 94 while the third sub-group S-3 is being advanced for insertion in compartment 96 when the rail 68 has been raised by the cam lobe 82*c*. This condition is shown in FIG. 12 where in the third sub-group S-3 is entering the compartment 96. On creation of a group in the magazine 88 one of the lugs 98 of the conveyor 97 advances the group to the infeed conveyor 186 of the wrapping machine as shown to the left of FIG. 7.

In the environment described above, the lug 72 in addition to feeding the articles along the track portions 68, functions to determine the number articles in each sub-group. FIG. 8 illustrates a sub-group of articles being transported by the lug 72 toward the magazine 88 and another rearward sub-group whose leading articles is rearwardly spaced from the lug 72. Also it should be observed that the track portion 62 is moved upwardly arresting movement of the single file of articles. The subsequent lug 72 commences to be erected by the camming members 76 and when, or as it reaches its erected orientation, (FIG. 9) it transports the sub-group by engaging the last article. On this occurrence the rails 62 are pivoted downwardly and brought into alignment with track portions 68 whereupon the single file of articles, which are moving from left to right at a higher speed than the lugs 72, comes into abutting contact with the rearward faces of the lugs 72. This condition is shown in FIG. 9A where the established sub-group of articles is to the right of lug 72 and the successive sub-group, to be created when the rails 62 are pivoted upwardly, is to the left of lug 72. By crowding or urging the article file against the lugs 72 the number of articles in each sub-group is determinable. As one of the lobes of cam 122 effect upward pivotal movement to the rails 62, the article file is "sheared" and a following lug 72 engages the created sub-group for transport to the magazine 88.

As briefly indicated, the concept of the present invention is considered to have utility in a variety of fields. Modifications encompassed by this disclosure, include the provision of more than one lane of aligned articles each associated with a track or support similar to track 62 and the fact that track 62 may be articulated to feed articles to a plurality of track portions 68. Moreover track portions 68 may be associated with systems (electrical, hydraulic, pneumatic or combination thereof) that sequentially, or as may be deemed appropriate by the application, to feed sub-groups of articles to compartments situated laterally or vertical and lateral as desired. In any event, the disclosed concept is susceptible to a variety of modifications dictated by the material handling objective involved.

Although the best mode contemplated for carrying out the present invention has been herein shown and described, it will be apparent that modification and variation may be made without departing from what is regarded to be the subject matter of the invention.

What is claimed is:

1. An article handling apparatus comprising a conveyor for storing and feeding a single file of articles, laterally spaced first rails portions for receiving and supporting a leading portion of the articles of the file, said rails being keyed to a transverse shaft located adjacent the entrance end of said rails, a lever having one end secured to said shaft and a cam follower roller rotatably mounted on the other end, a cam, said roller rollingly engageable with the surface of said cam, said cam being operative to oscillate said lever and rock said shaft so that said rails are momentarily displaced upwardly in response to the rotation of said cam, laterally spaced second rail portions in alignment with and defining a continuation of said first rail portions, said second rail portions being pivotally mounted at the end adjacent said first rail portions, a cam follower roller mounted for rotation below and adjacent the other end of said second rail portions, a cam profiled to define at least two camming surfaces, said last mentioned roller in rolling contact with second mentioned cam, regularly spaced generally L-shaped article feeding lugs pivotally mounted on chains located below and generally parallel to said rails, said lugs projecting between said second rail portions to engage the trailing end of the article or articles being fed, a magazine including at least two vertically spaced article receiving and storing compartments, said compartments defining a continuation of said second rail portions and formed with laterally spaced article receiving and supporting ledges, and a drive mechanism concurrently synchronously driving said cam and said chains to effect upward displacement of said first rail portions to thereby produce misalignment with said second rail portions so that feeding of articles to said second rail portions is interrupted and orbital movement of said lugs to feed articles supported thereby to the compartment of said magazine in alignment with said second rail portion.

2. An article handling apparatus according to claim 1 wherein a cam and aligned guide rails are provided to, respectively, erect and maintain said lugs erected to effect feeding of the articles.

3. An article handling apparatus according to claim 1 further comprising a conveyor overlying said magazine, said conveyor being operable to feed a group of articles from said magazine to a wrapping machine.

* * * * *